US006296117B1

(12) United States Patent
Chen

(10) Patent No.: US 6,296,117 B1
(45) Date of Patent: Oct. 2, 2001

(54) TENSIONER FOR A SUPPORTING DEVICE OF A GOLF BAG

(76) Inventor: Chiu-Teh Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/607,000

(22) Filed: Jun. 30, 2000

(30) Foreign Application Priority Data

Mar. 10, 2000 (TW) ..... 89203824

(51) Int. Cl.[7] ..... A63B 55/06

(52) U.S. Cl. ..... 206/315.7; 206/315.3; 248/96

(58) Field of Search ..... 206/315.3, 315.7; 248/96

(56) References Cited

U.S. PATENT DOCUMENTS 5,507,384 * 4/1996 Maeng ..... 206/315.7
5,762,189 * 6/1998 Reimers ..... 206/315.7
5,816,399 * 10/1998 Rhee ..... 206/315.7
5,816,544 * 10/1998 Hsieh ..... 206/315.7 X
5,829,719 * 11/1998 Han ..... 206/315.7 X
5,887,833 * 3/1999 Sundara et al. ..... 206/315.7 X

* cited by examiner

*Primary Examiner*—Sue A. Weaver
(74) *Attorney, Agent, or Firm*—Alan Kamrath; Rider, Bennett, Egan & Arundel, LLP

(57) ABSTRACT

A golf bag includes a bag body; a pivot seat attached to an upper portion of the bag body, two supporting rods each having an upper end pivotally attached to the pivot seat, and a support base attached to the lower portion of the bag body. The supporting rods are pivotable between an extended position and a retracted position in response to movement of the bag body between a tilted position and an upright position. Two resilient strips are provided and each includes an upper end securely attached to the upper end of an associated supporting rod to move therewith and a lower end securely attached to the support base. At least one of the resilient strips has a stop located at a predetermined level. A tensioner includes a longitudinal hole with two end portions through which the resilient strips extend, respectively. The tensioner is supported by the stop. In addition, the tensioner is securely retained around the resilient strips for controlling a resilient force of the resilient strips that urges the supporting rods into the retracted position.

5 Claims, 6 Drawing Sheets

TENSIONER FOR A SUPPORTING DEVICE OF A GOLF BAG

BACKGROUND OF THE INVENTION

1. Field of the Invention

The present invention relates to a tensioner for a supporting device of a golf bag.

2. Description of the Related Art

A typical golf bag may stand in an upright position or be supported in a tilted position by a supporting device or golf bag stand attached to the golf bag. U.S. Pat. No. 5,507,384 issued to Maeng on Apr. 16, 1996 discloses a golf bag stand tensioner that is movably fitted over a folding grip of the golf bag stand so that the tensioner selectively goes up and down the folding grip in order to control tensile force of the folding grip as well as tensile force of the golf bag stand. Nevertheless, although the tensioner is provided with a longitudinal reinforcing band on the outer surface thereof, it was found that the lips of the tensioner are expanded outward and deformed permanently. This adversely affects function of the tensioner. The present invention is intended to provide a golf bag stand tensioner that mitigates and/or obviates the above problems.

SUMMARY OF THE INVENTION

In accordance with a first aspect of the present invention, a golf bag comprises:

a bag body having an upper portion and a lower portion;

a pivot seat attached to the upper portion of the bag body;

two supporting rods each having an upper end pivotally attached to the pivot seat, the supporting rods being pivotable between an extended position and a retracted position in response to movement of the bag body between a tilted position and an upright position;

a support base attached to the lower portion of the bag body and being adapted to be located on the ground;

two resilient strips each including an upper end securely attached to the upper end of an associated said supporting rod to move therewith and a lower end securely attached to the support base, at least one of the resilient strips having a stop located at a predetermined level; and a tensioner including a longitudinal hole with two end portions through which the resilient strips extend, respectively, the tensioner being supported by the stop, the tensioner being securely retained around the resilient strips for controlling a resilient force of the resilient strips that urges the supporting rods into the retracted position.

In accordance with a second aspect of the invention, a golf bag comprises:

a bag body having an upper portion and a lower portion;

a pivot seat attached to the upper portion of the bag body;

two supporting rods each having an upper end pivotally attached to the pivot seat, the supporting rods being pivotable between an extended position and a retracted position in response to movement of the bag body between a tilted position and an upright position;

two connecting members each being integrally formed on the upper end of an associated said supporting rod, the upper end of each said connecting member being pivotally connected to the golf bag and thus pivotable about a pivotal axis, each said connecting member further including a receptacle extended in a direction parallel to the pivotal axis;

a support base attached to the lower portion of the bag body and being adapted to be located on the ground;

two resilient strips each including an upper end securely attached to the receptacle of an associated said connecting member to move therewith and a lower end securely attached to the supportbase; and a tensioner including a longitudinal hole with two end portions through which the resilient strips extend, respectively, the tensioner being supported by the stop, the tensioner being securely retained around the resilient strips for controlling a resilient force of the resilient strips that urges the supporting legs into the retracted position.

The tensioner includes a concave face in a side thereof, the concave face having a slot. A wedge is removably inserted into the longitudinal hole of the tensioner for retaining the resilient strips in place. The wedge includes a tenon for engaging with the slot of the tensioner.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
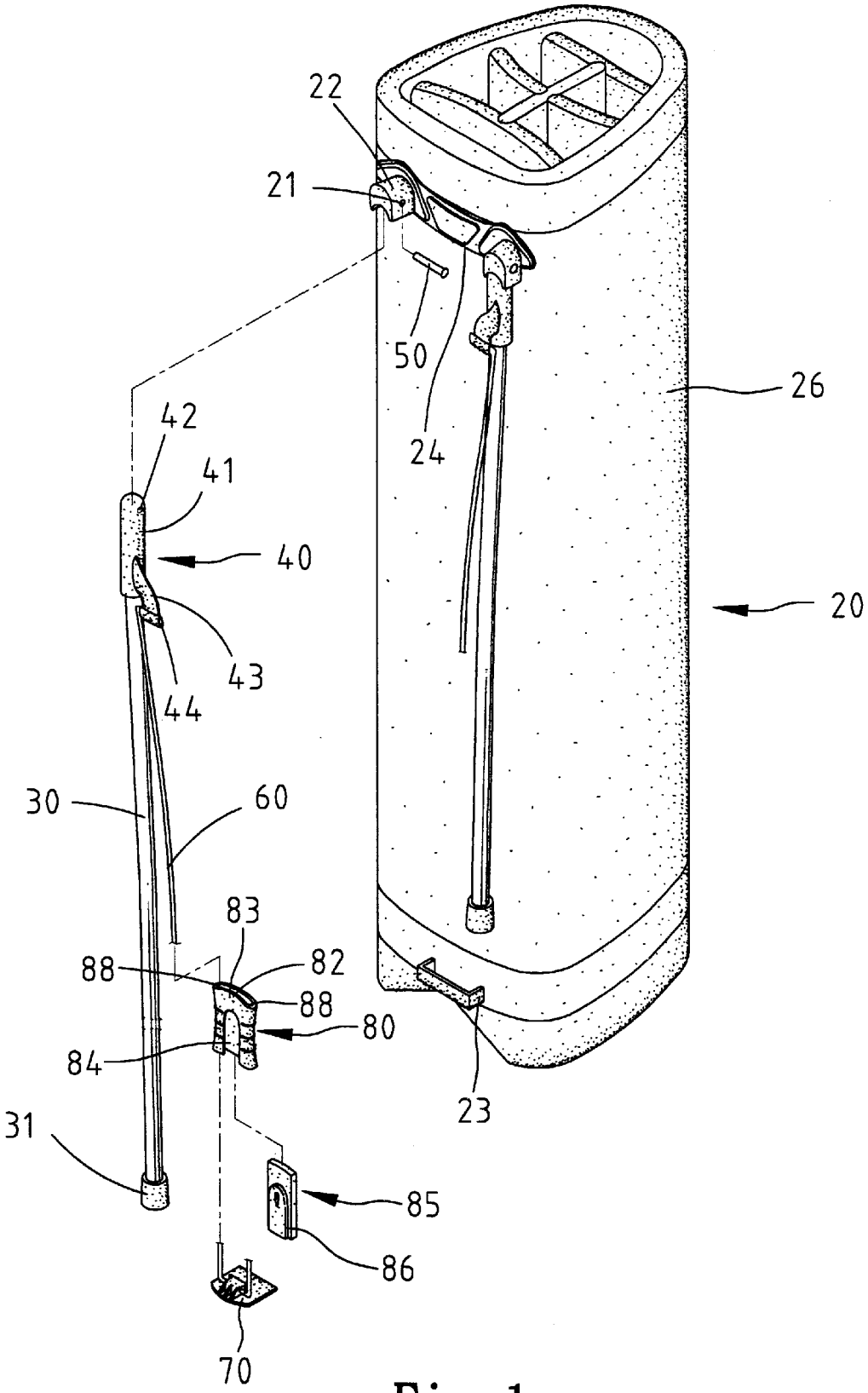
FIG. 1 is an exploded perspective view of a golf bag with a tensioner in accordance with the present invention.
Figure 2:
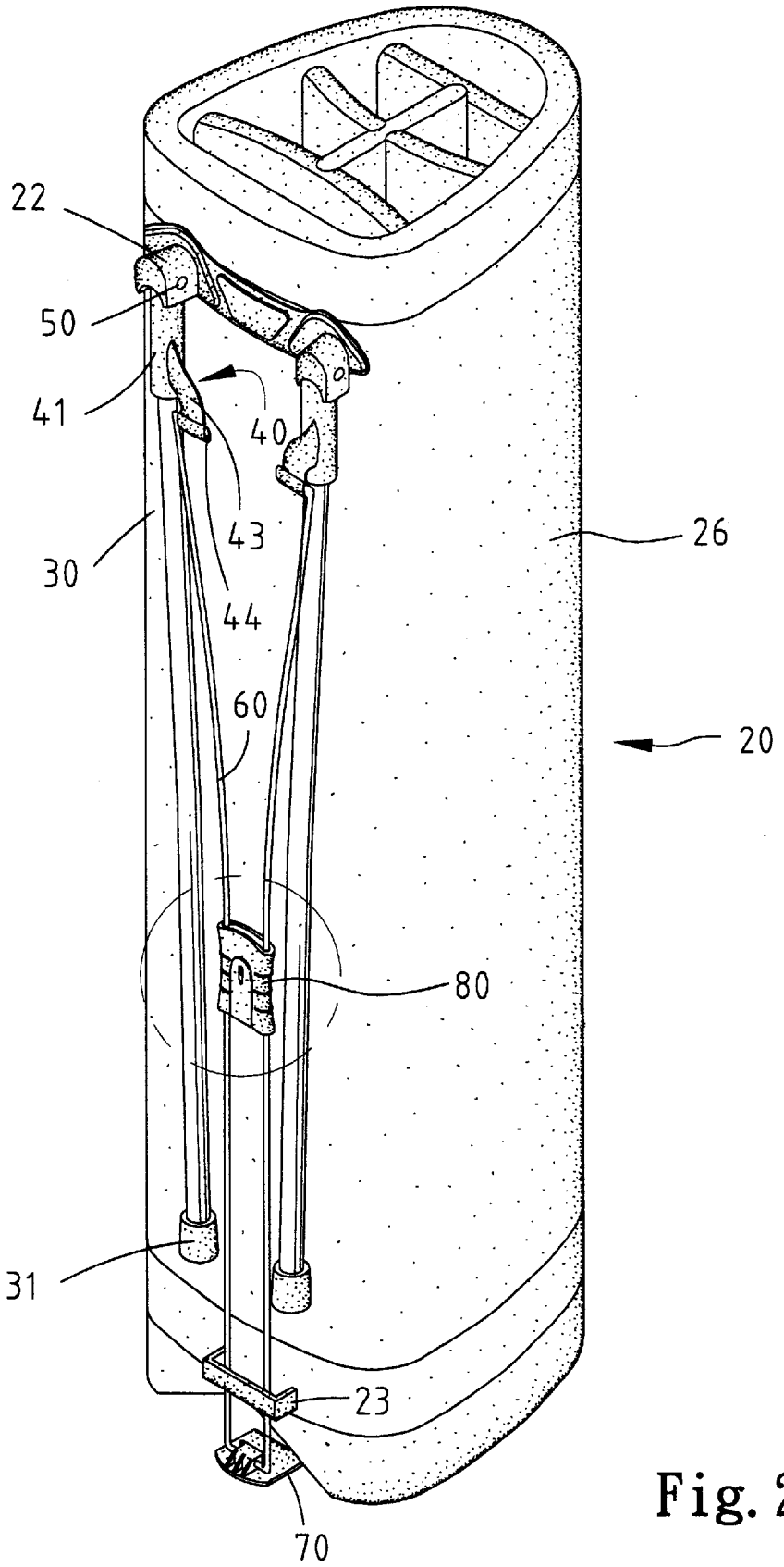
FIG. 2 is a perspective view of the golf bag in accordance with the present invention.

Referring to FIGS. 1 and 2, a golf bag 20 in accordance with the present invention includes a bag body 26 having two mounting seats 22 on an upper portion thereof and a substantially U-shape restrainer 23 on a lower portion thereof. The mounting seats 22 are integrally formed on a bracket 24 that is attached to the bag body 26 and act as a pivot seat. The golf bag 20 in accordance with the present invention further includes a supporting device comprising two supporting rods 30, two connecting means 40, two resilient strips 60, a tensioner 80, and a support base 70. Each supporting rod 30 includes a lower end 31 that may stand on the ground to support the golf bag 20 in a tilted position. Each connecting means 40 may be a connecting member 41 that is integrally formed on an upper end of an associated supporting rod 30. Each connecting member 41 includes a pivot hole 42 in an upper end thereof and a wing 43 extended from a lateral side thereof, the wing 43 including a receptacle 44. The wing 43 may be integrally formed on the connecting member 41 by injection molding. The receptacle 44 is parallel to the pivot hole 42. A pivot pin 50 is extended through a hole 21 in the mounting seat 22 and the pivot hole 42 in the connecting member 41, thereby pivotally connecting the supporting rod 30 to the mounting seat 22.

Figure 3:
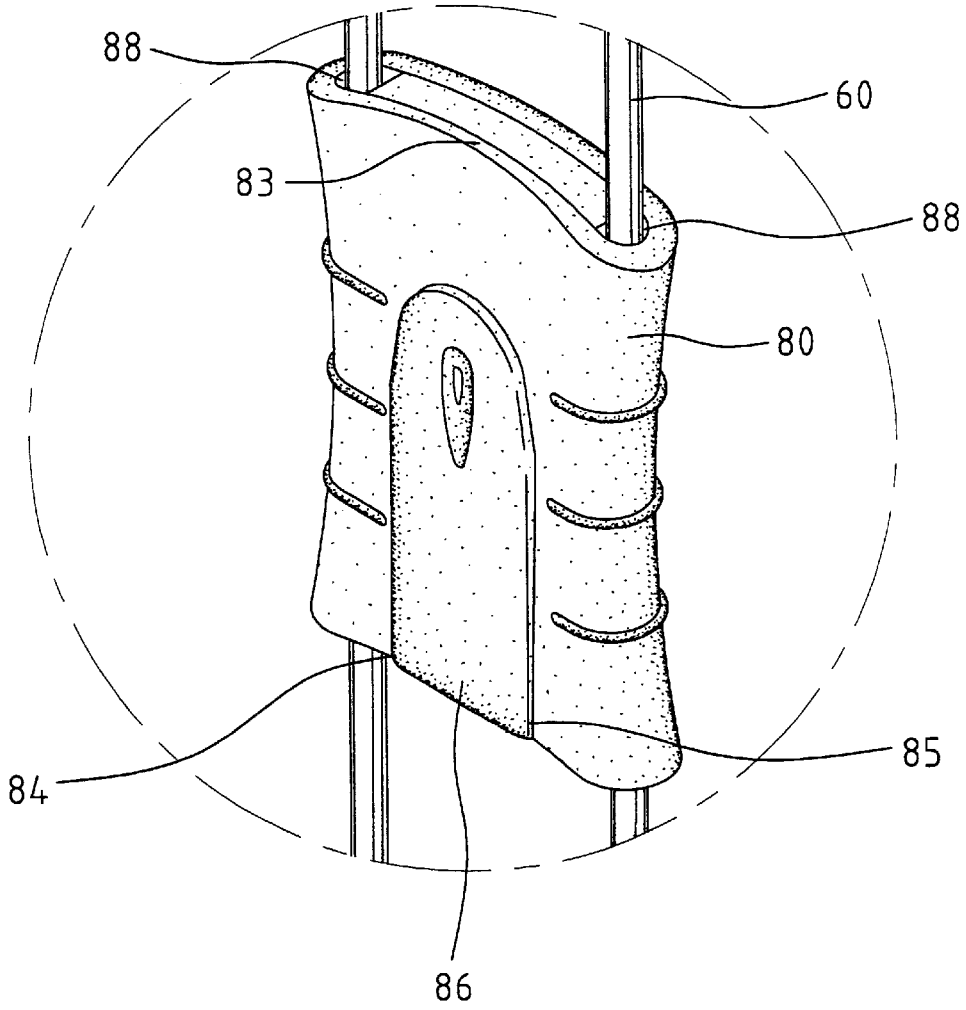
FIG. 3 is an enlarged view of a circle in FIG. 2.
Figure 7:
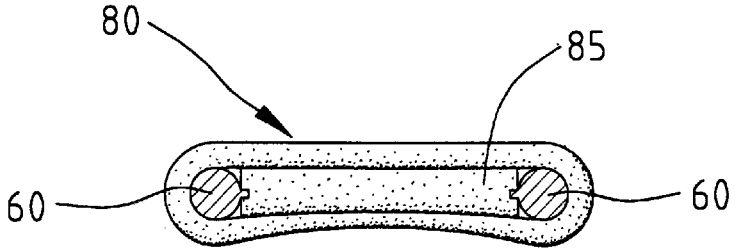
FIG. 7 is a sectional view taken along line 7—7 in FIG. 6.

Each resilient strip 60 includes an upper end securely received in the receptacle 44 of an associated connecting member 41 and a lower end securely attached to the support base 70 that is attached to the lower portion of the bag body 26. As illustrated in FIGS. 1 and 3, the tensioner 80 includes a longitudinal hole 82 having two end portions 88 through which the resilient strips 60 extend, respectively. The tensioner 80 includes a concave face 83 in a side thereof, which concave face 83 includes a slot 84 having an open side. A wedge 85 is inserted into the longitudinal hole 82 of the tensioner 80 to "squeeze" the resilient strips 60. Thus, the resilient strips 60 are retained in place, best shown in FIG. 7. The wedge 85 includes a tenon 86 that engages with the slot 84 of the tensioner 80, thereby preventing disengagement of the wedge 85 from the tensioner 80. The resilient strips 60 are tensioned by the tensioner 80 for urging the supporting rods 30 toward and thus bear against the golf bag 20 when the golf bag 20 is in an upright position. Thus, the supporting rods 30 will not sway or shake when carrying the golf bag 20.

Figure 4:
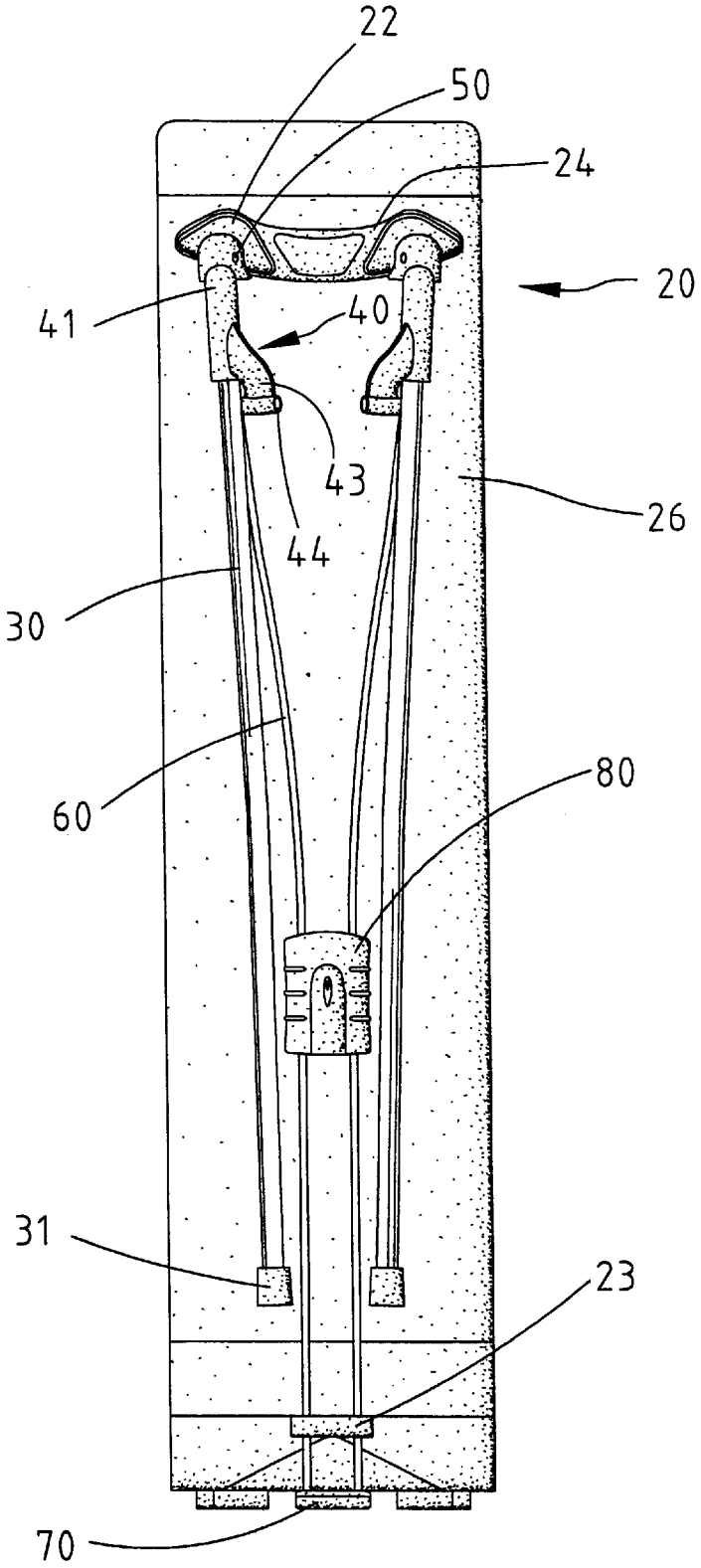
FIG. 4 is a rear view of the golf bag in accordance with the present invention.

As illustrated in FIGS. 2 and 4, the golf bag 20 may stand in an upright position wherein lower portions of the resilient strips 60 are guided by the restrainer 23. The support base 70 is located on the ground to provide assistance to stable support.

Figure 5:
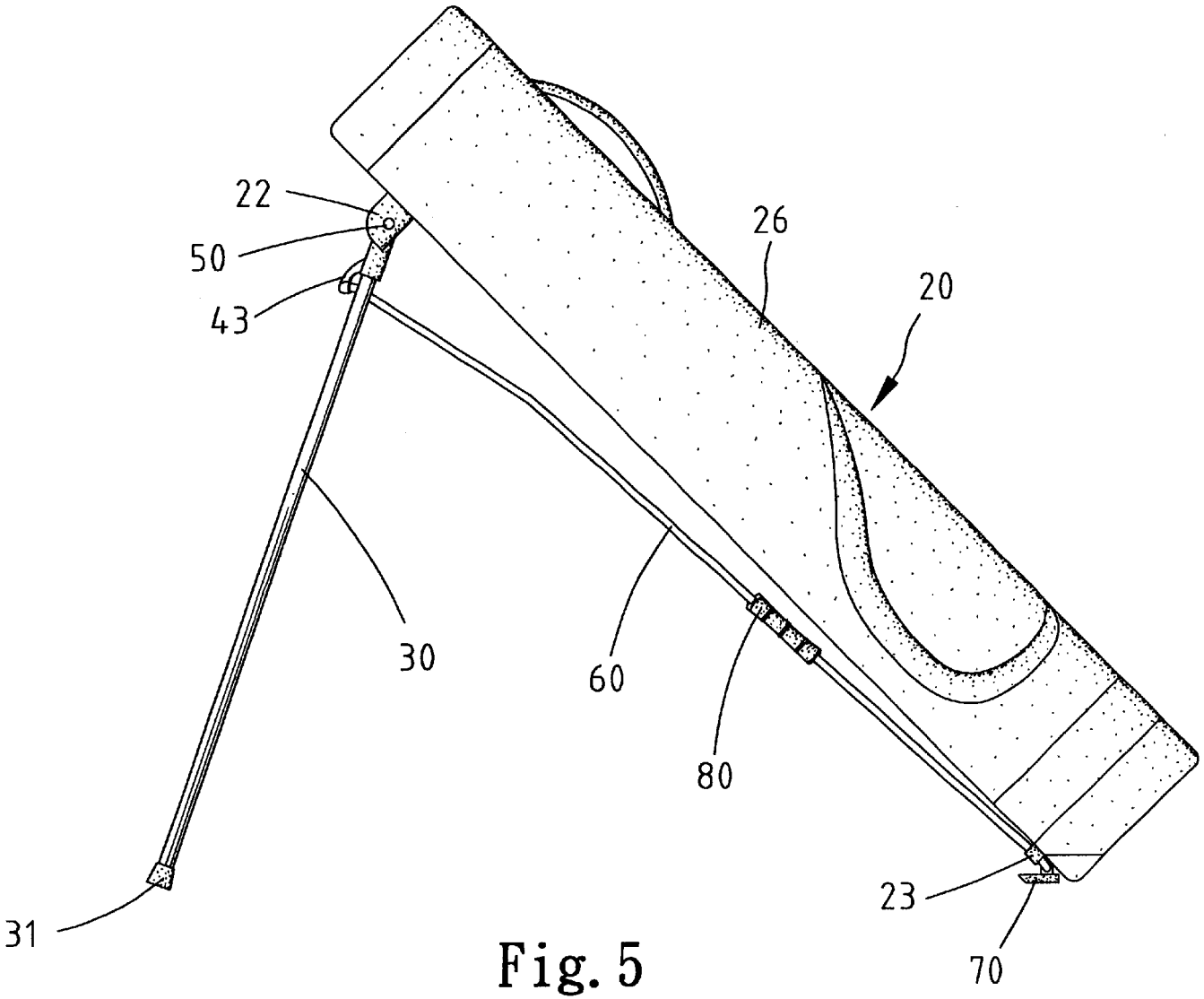
FIG. 5 is a side view of the golf bag in FIG. 4, wherein the golf bag is supported in a tilted position.
Figure 6:
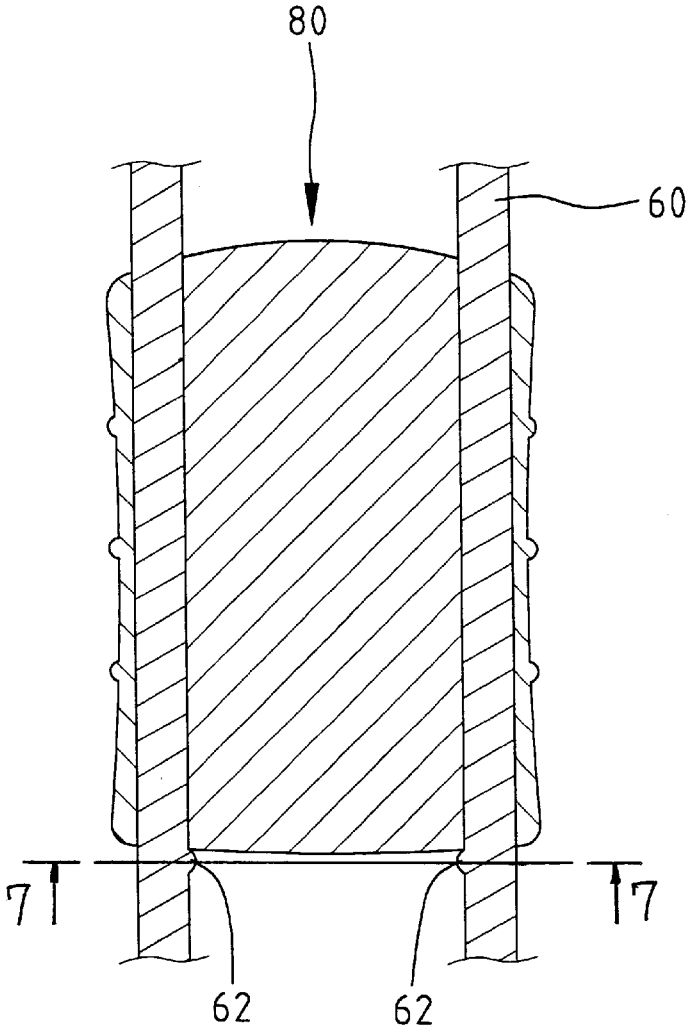
FIG. 6 is a sectional view of the tensioner and two resilient strips.

Referring to FIG. 5, the supporting rods 30 may be manually pivoted outward to support the golf bag 20 in a tilted position by the lower ends 31. The support base 70 and the resilient strips 60 are moved upward, yet the support base 70 is still located on the ground to provide a stable support. Each wing 43 is also pivoted while the receptacle 44 to which an associated resilient strip 60 is attached is kept parallel to the pivot pin 50. The tensioner 80 does not move relative to strips 60 during operation. Further, as illustrated in FIG. 6, each resilient strip 60 has a stop 62 formed on an outer periphery thereof, the stops 62 being located at the same level for supporting the tensioner 80 at a predetermined level. It is noted that resilient strips 60 have an optimal tension when the tensioner 80 is supported by the stops 62 that are located at a predetermined level. The level of the stops 62 is determined by tests to provide the resilient strips 60 with the optimal tension. There is no need for the user to adjust the level of the tensioner 80. When the golf bag 20 is lifted off the ground or tilted back to the upright position, the resilient strips 60 urge the supporting rods 30 to their retracted position.

According to the above description, it is appreciated that the tensioner 80 of the present invention is sturdy in structure and easy to assemble.

Although the invention has been explained in relation to its preferred embodiment, it is to be understood that many other possible modifications and variations can be made without departing from the spirit and scope of the invention as hereinafter claimed.

What is claimed is:

1. A golf bag comprising:

a bag body having an upper portion and a lower portion;

a pivot seat attached to the upper portion of the bag body;

two supporting rods each having an upper end pivotally attached to the pivot seat, the supporting rods being pivotable between an extended position and a retracted position in response to movement of the bag body between a tilted position and an upright position;

a support base attached to the lower portion of the bag body and being adapted to be located on the ground;

two resilient strips each including an upper end securely attached to the upper end of an associated said supporting rod to move therewith and a lower end securely attached to the support base, at least one of the resilient strips having a stop located at a predetermined level; and a tensioner including a longitudinal hole with two end portions through which the resilient strips extend, respectively, the tensioner being supported by the stop, the tensioner being securely retained around the resilient strips for controlling a resilient force of the resilient strips that urges the supporting rods into the retracted positions the tensioner including a concave face in a side thereof, the concave face having a slot, further comprising a wedge removably inserted into the longitudinal hole of the tensioner for retaining the resilient strips in place, the wedge including a tenon for engaging with the slot of the tensioner.

2. A golf bag comprising:

a bag body having an upper portion and a lower portion;

a pivot seat attached to the upper portion of the bag body;

two supporting rods each having an upper end pivotally attached to the pivot seat, the supporting rods being pivotable between an extended position and a retracted position in response to movement of the bag body between a tilted position and an upright position;

two connecting members each being integrally formed on the upper end of an associated said supporting rod, the upper end of each said connecting member being pivotally connected to the golf bag and thus pivotable about a pivotal axis, each said connecting member further including a receptacle extended in a direction parallel to the pivotal axis;

a support base attached to the lower portion of the bag body and being adapted to be located on the ground;

two resilient strips each including an upper end securely attached to the receptacle of an associated said connecting member to move therewith and a lower end securely attached to the support base;

a tensioner including a longitudinal hole with two end portions through which the resilient strips extend, respectively, the tensioner being supported by the stop, the tensioner being securely retained around the resilient strips for controlling a resilient force of the resilient strips that urges the supporting legs into the retracted position; and the tensioner including a concave face in a side thereof, the concave face having a slot, further comprising a wedge removably inserted into the longitudinal hole of the tensioner for retaining the resilient strips in place, the wedge including a tenon for engaging with the slot of the tensioner.

3. The golf bag as claimed in claim 2, wherein each said connecting member is integrally formed on the associated supporting rod.

4. The golf bag as claimed in claim 2, wherein each said connecting member includes an integrally formed wing in which an associated said receptacle is defined.

5. A golf bag comprising:

a bag body having an upper portion and a lower portion;

a pivot seat attached to the upper portion of the bag body;

two supporting rods each having an upper end pivotally attached to the pivot seat, the supporting rods being pivotable between an extended position and a retracted position in response to movement of the bag body between a tilted position and an upright position;

a support base attached to the lower portion of the bag body and being adapted to be located on the ground;

two resilient strips each including an upper end securely attached to the upper end of an associated said supporting rod to move therewith and a lower end securely attached to the support base, at least one of the resilient strips having a stop located at a predetermined level;

a tensioner including a longitudinal hole with two end portions through which the resilient strips extend, respectively, the tensioner being supported by the stop, the tensioner being securely retained around the resilient strips for controlling a resilient force of the resilient strips that urges the supporting rods into the retracted position; and a wedge removably inserted into the longitudinal hole of the tensioner for retaining the resilient strips in place.

* * * * *